US010046342B2

(12) United States Patent
Zhang et al.

(10) Patent No.: US 10,046,342 B2
(45) Date of Patent: Aug. 14, 2018

(54) SIDE SPRAYING OUTLET DEVICE

(71) Applicants: XIAMEN SOLEX HIGH-TECH INDUSTRIES CO., LTD., Xiamen, Fujian (CN); Huasong Zhou, Xiamen, Fujian (CN)

(72) Inventors: Mingfu Zhang, Xiamen (CN); Yulin Wu, Xiamen (CN); Lei Wang, Xiamen (CN); Huasong Zhou, Xiamen (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 38 days.

(21) Appl. No.: 14/150,255

(22) Filed: Jan. 8, 2014

(65) Prior Publication Data

US 2015/0115062 A1 Apr. 30, 2015

(30) Foreign Application Priority Data

Oct. 25, 2013 (CN) ..... 2013 2 0666162 U

(51) Int. Cl.

| | |
|---|---|
| ***B05B 1/20*** | (2006.01) |
| ***B05B 1/18*** | (2006.01) |
| ***E03C 1/04*** | (2006.01) |
| ***B05B 1/30*** | (2006.01) |

(52) U.S. Cl.

CPC ..... *B05B 1/185* (2013.01); *B05B 1/20* (2013.01); *B05B 1/3026* (2013.01); *E03C 1/0408* (2013.01)

(58) Field of Classification Search

CPC .. B05B 1/18; B05B 1/185; B05B 1/20; B05B 1/3026; E03C 1/025; E03C 1/02

USPC ..... 239/273, 443; 4/601, 567–570, 615

See application file for complete search history.

(56) References Cited

U.S. PATENT DOCUMENTS

| | | | | |
|---|---|---|---|---|
| 6,594,832 | B2 * | 7/2003 | Yang | A47K 3/28 239/283 |
| 7,219,376 | B1 * | 5/2007 | Zhou | E03C 1/06 239/280.5 |
| 7,360,723 | B2 * | 4/2008 | Lev | B05B 1/16 239/442 |
| 7,458,112 | B1 * | 12/2008 | Yang | E03C 1/0408 137/625.47 |
| 7,918,424 | B1 * | 4/2011 | Wu | E03C 1/06 239/587.1 |
| 7,987,533 | B2 * | 8/2011 | Phipps | E03C 1/0408 4/596 |
| 2007/0022528 | A1 * | 2/2007 | Gilbert | B05B 1/18 4/615 |
| 2008/0073446 | A1 * | 3/2008 | Zhou | B05B 1/185 239/289 |
| 2009/0007330 | A1 * | 1/2009 | Genord | E03C 1/06 4/695 |

* cited by examiner

*Primary Examiner* — Chee-Chong Lee

(74) *Attorney, Agent, or Firm* — Rabin & Berdo, P.C.

(57) ABSTRACT

A side spraying outlet device is assembled to a supporting arm fixed to the wall, wherein the outlet device includes a side spraying component. The side spraying component includes a fixed portion secured to the wall and at least a side spraying mechanism disposed in the fixed portion, the fixed portion is disposed with a first diversion waterway, the side spraying mechanism is connected to the first diversion waterway; the side spraying component is connected to the supporting arm by a first flexible pipe.

15 Claims, 8 Drawing Sheets

SIDE SPRAYING OUTLET DEVICE

FIELD OF THE INVENTION

The present invention relates to a side spraying outlet device.

BACKGROUND OF THE INVENTION

Existing side spraying outlet device is assembled to a supporting arm, the supporting arm is secured to the wall; the side spraying outlet device is connected to the supporting arm by hard pipe, the side spraying outlet device is fixed to the wall. So that the side spraying outlet device is fixed with respect to the supporting arm, the side spraying outlet device is fixed with respect to the wall, as the supporting arm is fixed with respect to the side spraying outlet device, it needs to ensure the assembly position when assembling, thus making it high assembly cost. Moreover, the assembly position is not adjustable.

SUMMARY OF THE INVENTION

The present invention is provided with a side spraying outlet device, which overcomes the disadvantages of the existing side spraying outlet device.

The technical proposal of the present invention to solve the technical problem is as below:

A side spraying outlet device, which is assembled to a supporting arm (200) fixed to the wall, wherein the outlet device comprising a side spraying component (100), the side spraying component (100) comprising a fixed portion and at least a side spraying mechanism (120) disposed in the fixed portion (110), the fixed portion (110) is disposed with a first diversion waterway, the side spraying mechanism (120) is connected to the first diversion waterway; the side spraying component (100) is connected to the supporting arm (200) by a first flexible pipe (300).

In another preferred embodiment, it further comprising a hand shower (400); the fixed portion (110) further disposed with an inlet waterway and another first diversion waterway, the inlet waterway is connected to the first flexible pipe (300), the hand shower (400) is connected to the other first diversion waterway by a second flexible pipe (410); the fixed portion (110) is further disposed with a first switch mechanism (130), the first switch mechanism (130) is cooperated to the inlet waterway and two first diversion waterways to switch the two first diversion waterway, thus controlling the hand shower (400) or the side spraying mechanism (120) to discharge water.

In another preferred embodiment, the fixed portion (110) is disposed with a connecting base (140) to hold the hand shower (400).

In another preferred embodiment, the first switch mechanism (130) is disposed in the upper portion (1101) of the fixed portion (110), the connection of the other first diversion waterway and the second flexible pipe (410) is situated in the lower portion (1102) of the fixed portion (110).

In another preferred embodiment, the fixed portion (110) comprising a housing (111), a lower joint (112) and an upper joint (113), the housing (111) is secured to the wall; the other first diversion waterway comprising a third flexible pipe inside the housing (111), the upper joint (113) is assembled to the upper end (1110) of the housing (111) and is connected to the first flexible pipe (300) and the first switch mechanism (130), the lower joint (112) is fixed to the lower end (1111) of the housing (111) and is connected to the third flexible pipe and the second flexible pipe (410).

In another preferred embodiment, the connecting base (140) comprising a plug socket (141), the plug socket (141) is fixed to the fixed portion (110).

In another preferred embodiment, the first switch mechanism (130) comprising a first valve fixed inside the fixed portion (110), a first switch base able to rotate with respect to the first valve and at least a first hand partially outside the fixed portion (110) for user to operate, the first valve is disposed with two first water diversion openings respectively connected to the two diversion waterways, the inlet waterway is connected to the first valve, the first switch base rotates to control the two first water diversion openings to connect to the inlet waterway.

In another preferred embodiment, it further comprising a head shower (500), the supporting arm (200) is disposed with a second switch mechanism (600), the second switch mechanism (600) is connected to the supporting arm (200), the head shower (500) and the first flexible pipe (300) to switch the head shower (500) or the first flexible pipe (300) to connect to the supporting arm (200).

In another preferred embodiment, the second switch mechanism (600) comprising a second valve fixed in the end of the supporting arm (200), a second switch base able to rotate with respect to the second valve and at least a second handle partially outside the second valve for user to operate, the second valve is disposed with two second water diversion openings respectively connected to the head shower (500) and the first flexible pipe (300), the second valve is connected to the supporting arm, the second switch base rotates to switch the two second water diversion openings.

Compared to the existing technology, the technical proposal of the present invention has advantages as below:

1. the side spraying component is connected to the supporting arm by flexible pipe, the side spraying component is not fixed with respect to the support arm and the assembly portion thereof is adjustable, thus making it easy to assemble.
2. the first switch mechanism is disposed in the fixed portion of the side spraying component, the position is lower relatively, thus making it easy to switch.
3. The switch mechanism is fixed to the upper portion of the fixed portion, thus making it with tight structure and reasonability.
4. the plug socket and the handle are respectively disposed in the two sides of the fixed portion in the upper portion of the fixed portion, thus making it with tight structure.
5. the second switch mechanism is assembled in the end of the supporting arm to cooperate with the first switch mechanism, thus making the outlet device with multi-function, thus satisfying the needs of the household water.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
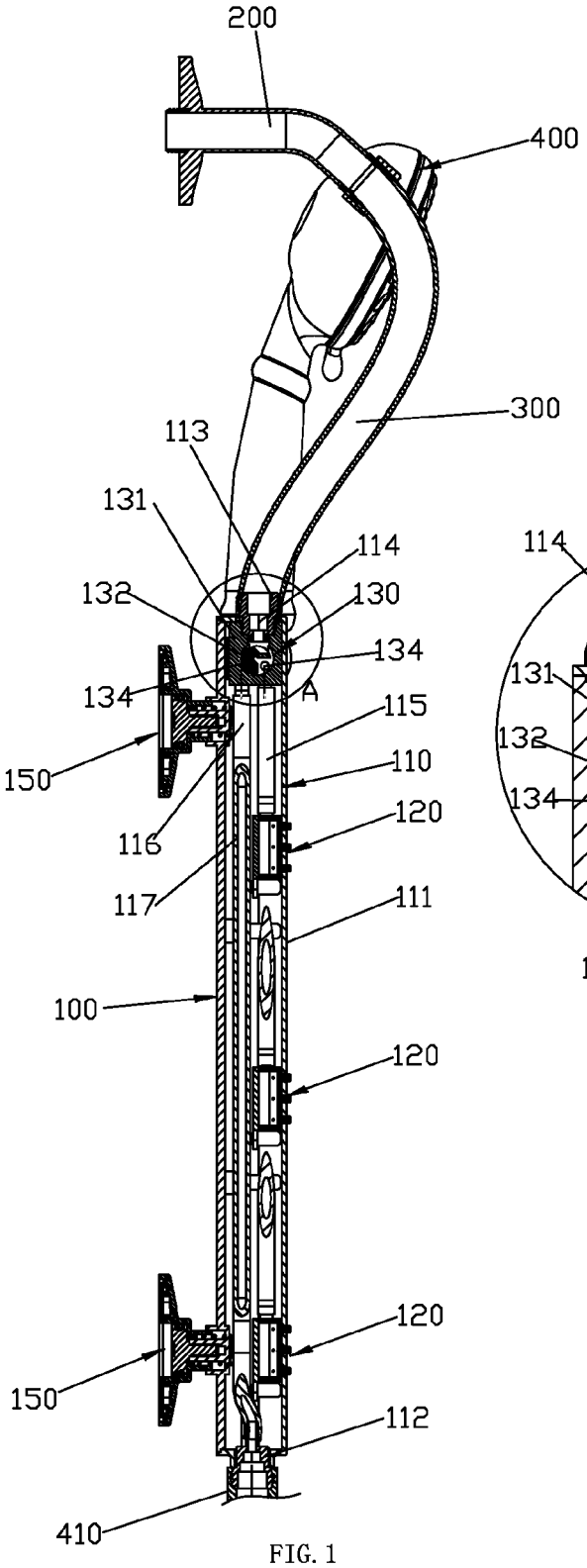
FIG. 1 illustrates a sectional view of the outlet device of the first embodiment.
Figure 2:
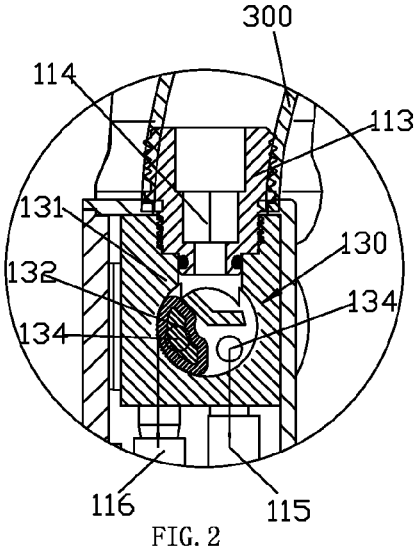
FIG. 2 illustrates an enlarging view of the A part of the FIG. 1.
Figure 3:
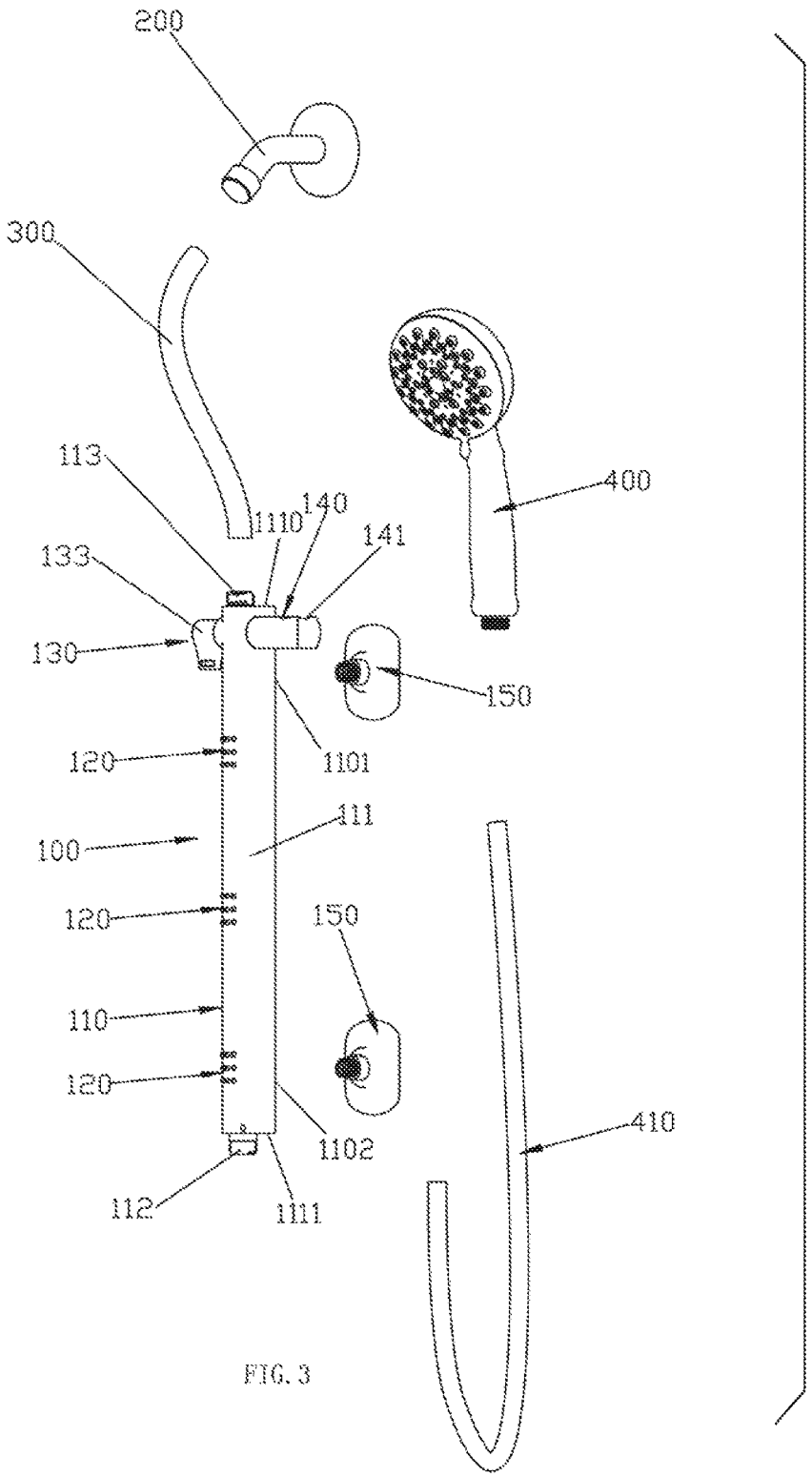
FIG. 3 illustrates an exploded diagram of the outlet device of the first embodiment.
Figure 4:
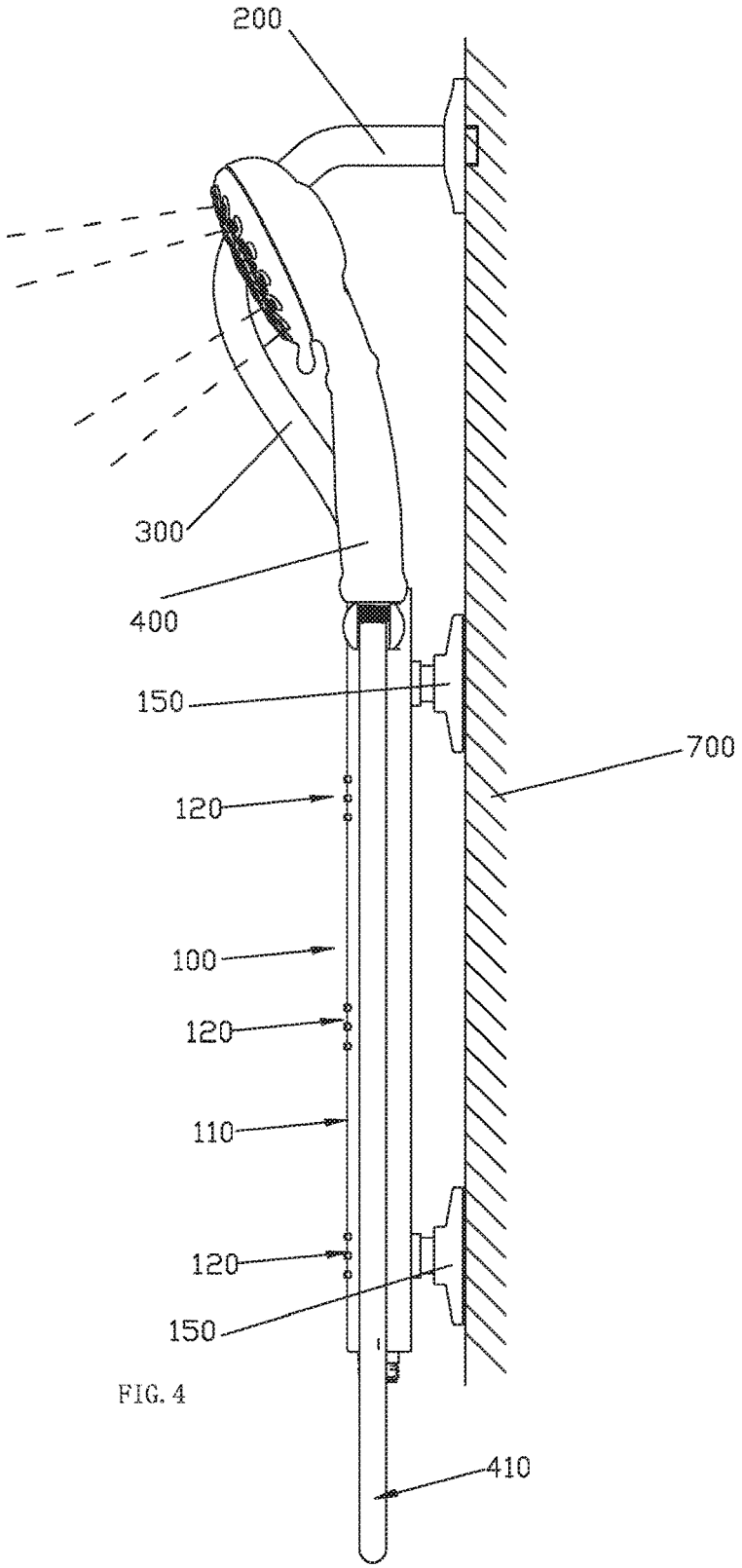
FIG. 4 illustrates a first side view of the outlet device of the first embodiment in first working state.
Figure 5:
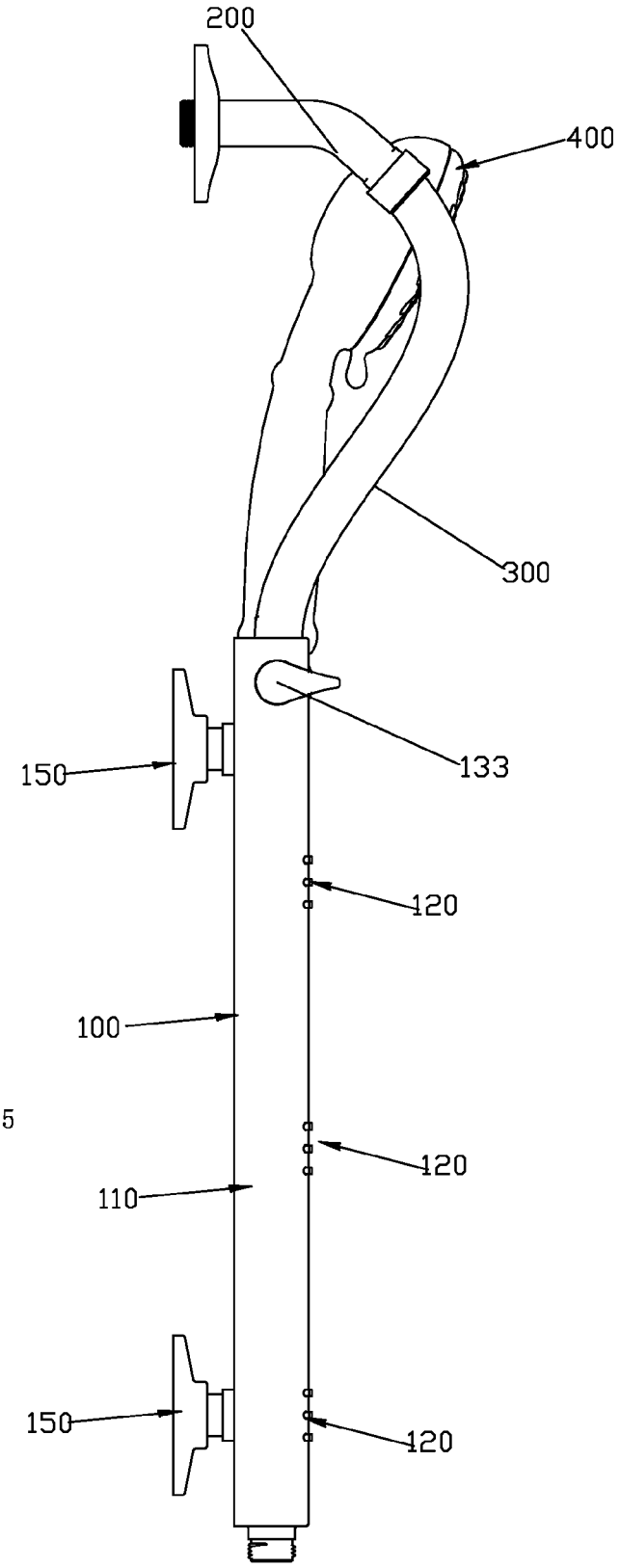
FIG. 5 illustrates a second side view of the outlet device of the first embodiment in first working state.
Figure 6:
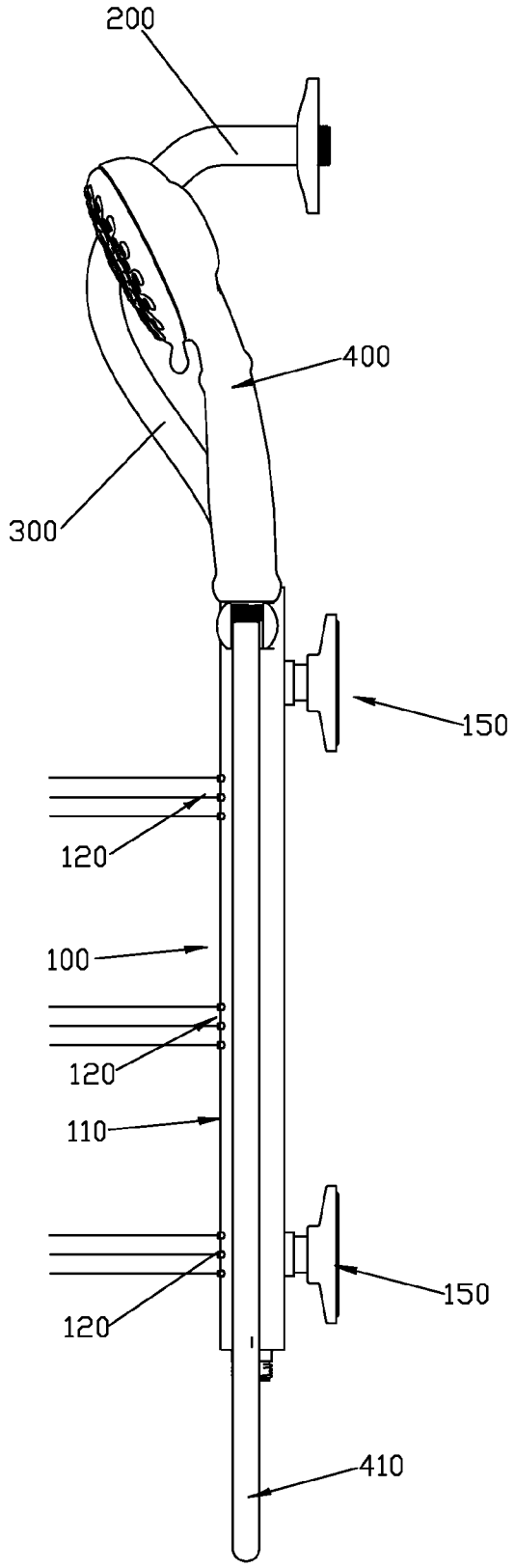
FIG. 6 illustrates a first side view of the outlet device of the first embodiment in second working state.
Figure 7:
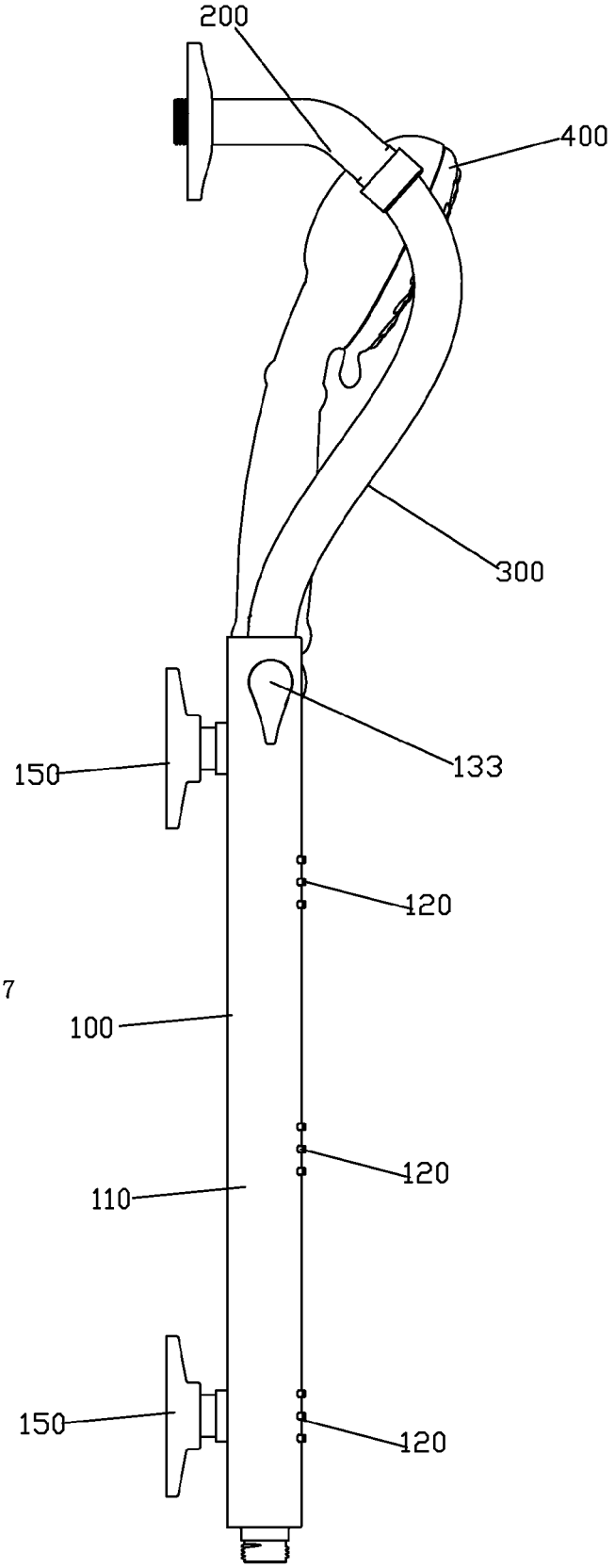
FIG. 7 illustrates a second side view of the outlet device of the first embodiment in second working state.

Please refer to FIG. 1 to FIG. 7, disclosed is a side spraying outlet device, which can be assembled to a supporting arm 200 fixed to the wall, the supporting arm 200 is secured to the wall and is able to supply water; the outlet device comprising a side spraying component 100 and a hand shower 400.

The side spraying component 100 comprising a fixed portion 110 fixed to the wall and at least a side spraying mechanism 120 assembled to the fixed portion 110, in this embodiment, it is disposed with three side spraying mechanisms 120, the three side spraying mechanisms 120 are spaced arranged up and down. The fixed portion 110 is disposed with an inlet waterway 114 and two first diversion waterway 115, 116. A first flexible pipe 300 is connected between the side spraying mechanism 120 and the supporting arm 200, the inlet waterway 114 is connected to the supporting arm 200 by the first flexible pipe 300 to lead water to the inlet waterway 114, then it is cooperated with a first switch mechanism to make the water of the supporting arm 200 flowing to the first diversion waterway 115, the side spraying mechanism 120 can be connected to the first diversion waterway 115, the hand shower 500 is connected to the other diversion waterway 116 by a second flexible pipe 410.

The fixed portion 110 is further disposed with a first switch mechanism 130, which is cooperated to the inlet waterway 114 and two first diversion waterways 115, 116 to switch the two first diversion waterways 115, 116 to connect to the inlet waterway 114, thus controlling the hand shower 400 or the side spraying mechanism 120 to discharge water. The fixed portion 110 is further disposed with a connecting base 140, which is used the hold the hand shower 400.

The fixed portion 110 comprising a housing 111, a lower joint 112 and an upper joint 113, the housing 111 is secured to the wall 700, in this embodiment, the housing 111 is detachably secured to the wall 700 by two sucker mechanisms 150, as needed, other securing assemblies are available, for example a securing assembly that cannot be detached, for example screwing securing. The upper joint 113 is assembled to the upper end of the housing 111, the lower joint 112 is assembled to the lower end of the housing 111, the inlet waterway comprising the inner hole of the upper joint 113.

Preferred, the switch mechanism 130 is disposed in the upper portion of the fixed portion 110; the switch mechanism 130 comprising a first valve 131 inside the housing 111, a rotating base 132 able to rotate with respect to the first valve 131 and at least a handle 133 partially outside the housing 111 for the user to operate, the switch valve 131 is disposed with two first water diversion openings 134 respectively connected to the two first diversion waterways 115, 116, the inlet waterway 114 is connected to the first valve 131, when controlling the rotating base 132 to rotate with respect to the first valve 131 by the handle 133, the two first diversion openings 114 are controlled to alternately connect to the inlet waterway. In this embodiment, the switch mechanism is applied with a rotating switch mode, but not limited to this, as needed, sliding switch mode is available. As needed, a sealing pad is disposed in the switch valve, thus implementing accurate switch.

The second waterway 113 comprising a third flexible pipe 117 inside the housing, the lower joint 112 is fixed to the lower end of the housing 111, the lower joint 112 is connected to the third flexible pipe 117 and the second flexible pipe 410, so that the connection of the second waterway 113 and the second flexible pipe 117 is situated at the lower portion of the fixed portion. The upper joint 113 is connected to the first flexible pipe 300 and the first switch mechanism 130 to lead water to the upper joint and then to the first valve 131.

The connecting base 140 comprising a plug socket 141, which is fixed to the upper portion of the housing 111, preferred, the plug socket 141 and the handle 133 are respectively disposed in the left and the right sides of the housing 111.

The Second Embodiment

The difference of the second embodiment from the first embodiment is that the outlet device is disposed without a hand shower, so that it doesn't need a first switch mechanism. As needed, an on-off mechanism is disposed in the fixed portion.

The Third Embodiment

Figure 8:
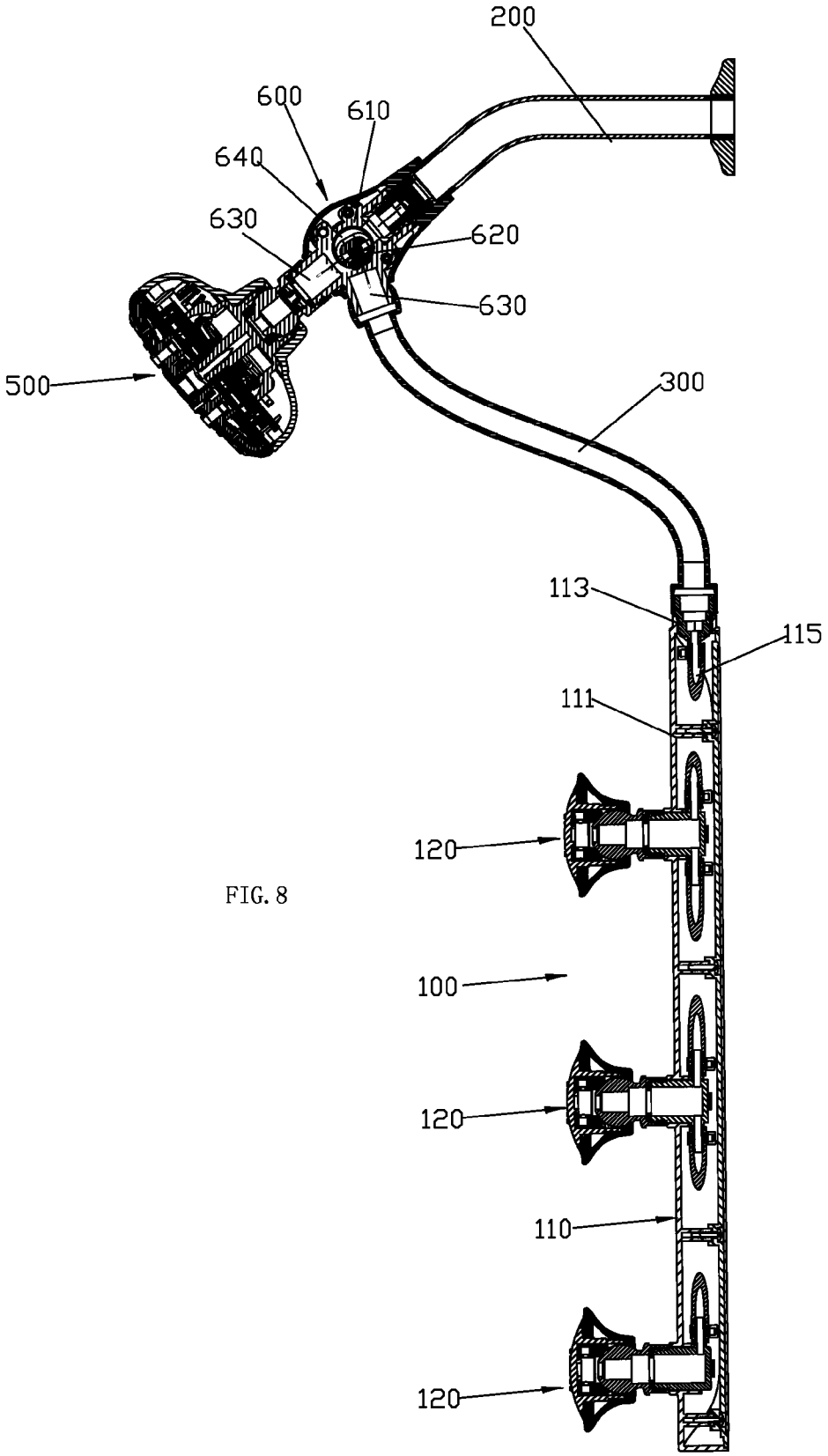
FIG. 8 illustrates a sectional view of the outlet device of the third embodiment.

As fired in FIG. 8, disclosed is a side spraying outlet device, which is assembled to a supporting arm 200 secured to the wall, the supporting arm 200 is fixed to the wall to supply water; the outlet device comprising a side spraying component 100 and a head shower 500.

The side spraying component 100 comprising a fixed portion 110 fixed to the wall and at least a side spraying mechanism 120 assembled to the fixed portion 110, in this embodiment, it is disposed with three side spraying mechanisms 120, the three side spraying mechanisms 120 are spaced arranged up and down. The fixed portion 110 is disposed with a first diversion waterway 115. A first flexible pipe 300 is connected between the side spraying mechanism 120 and the supporting arm 200, the first flexible pipe 300 is connected to the supporting arm to lead water to the first diversion waterway 115, the side spraying mechanisms are connected to the first diversion waterway 115.

The fixed portion 110 comprising a housing 111 and an upper joint 113, the housing 111 is secured to the wall. The upper joint 113 is assembled to the upper end of the housing 111, and is connected to the first flexible pipe 300 and the first diversion waterway 115.

The supporting arm 200 is disposed with a second switch mechanism 600, which is connected to the supporting arm 200, the head shower 500 and the first flexible pipe 300 to switch the head shower 500 or the first flexible pipe 300 to connect to the supporting arm 200.

Preferred, the second switch mechanism 600 comprising a second valve 610 fixed in the end of the supporting arm 200, a second switch base 620 able to rotate with respect to the second valve 610 and at least a second hand partially disposed outside the second valve 610 for the user to operate, the second valve 610 is disposed with two second water diversion openings 630 respectively connected to the head shower 500 and the first flexible pipe 300, the second valve body 610 is connected to the supporting arm, two water diversion openings are switched by rotating the second switch base 620. in this embodiment, the second valve 610 is disposed with a revolution cavity 640, the supporting arm and the two second water diversion openings are connected to the revolution cavity; the second switch base 620 is rotatably connected to the revolution cavity and can slide at least between a first position and a second position, when the second switch base 620 is situated in the first position, it closes one of the second water diversion openings while being away from the other one, and water flows out of the other second water diversion opening. As needed, water can be cut off by the second switch base 620, so that there is a third position the second switch base 620 can be positioned, the third position is disposed between the first position and the second position, when the second switch base 620 is situated in the third position, it seals the opening of the supporting arm, or it seals two second water diversion openings, in other case, an on-off valve is disposed in the supporting arm.

The Fourth Embodiment

Figure 9:
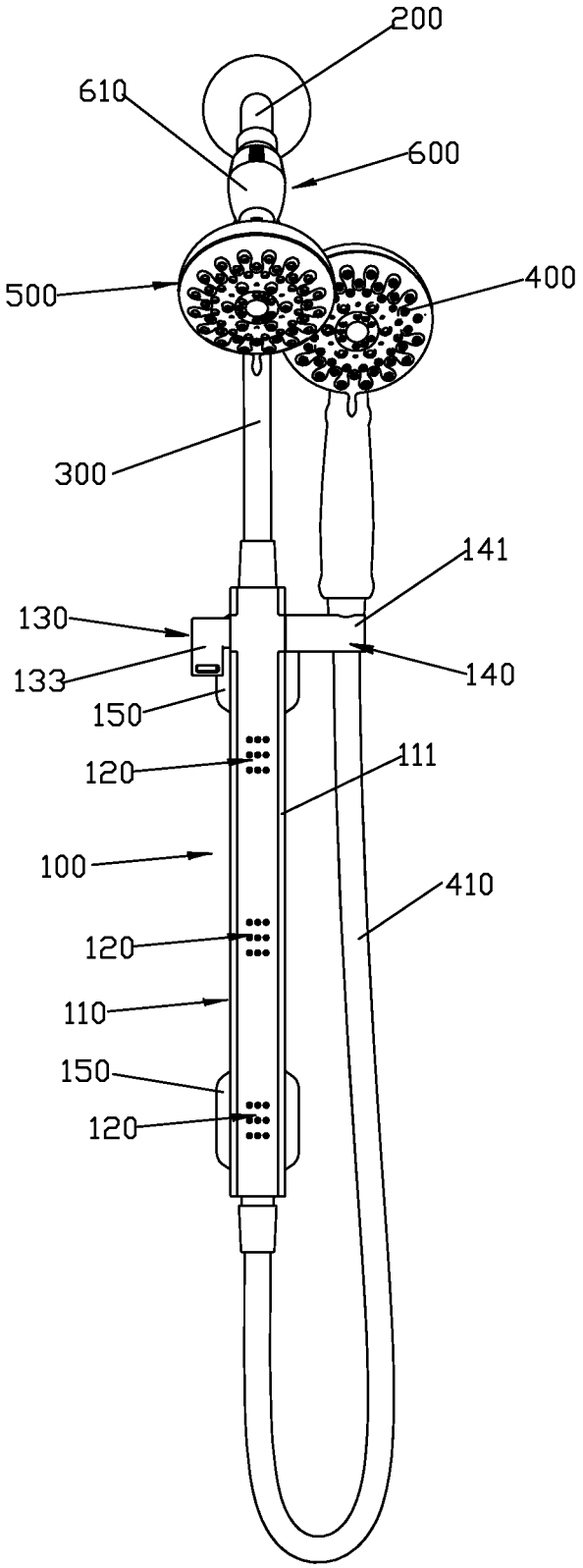
FIG. 9 illustrates a schematic diagram of the outlet device of the fourth embodiment.

As figured in FIG. 9, the difference of the fourth embodiment from the third embodiment is that it combines with the first embodiment, it further comprising a hand shower 400, the structure can be understood well by reference to the first embodiment.

The fixed portion (110) is disposed with an inlet waterway 114 and two first diversion waterways 115, 116. the inlet waterway 114 is connected to the supporting arm 200 by the first flexible pipe 300 to lead water to the inlet waterway 114, then with the first switch mechanism, water in the supporting arm 200 flows to the first diversion waterway 115, the side spraying mechanism 120 can be connected to the first diversion waterway 115, the hand shower 400 is connected to the first diversion waterway 116 by the second flexible pipe 410.

The fixed portion 110 is further disposed with a first switch mechanism 130, the first switch mechanism 130 is cooperated with the inlet waterway 114 and the two first diversion waterways 115, 116 to switch the two first diversion waterways 115, 116 to connect to the inlet waterway 114, thus controlling the hand shower 400 or the side spraying mechanism 120 to discharge water. The fixed portion 110 is further disposed with a connecting base 140, which is used to hold the hand shower 400. the fixed portion 110 is further disposed with a lower joint 112, the lower joint 112 is assembled to the lower end of the housing 111, the inlet waterway comprising the inner hole of the upper joint 113.

Preferred, the first switch mechanism 130 is disposed in the upper portion of the fixed portion 110, the firsts switch mechanism 130 comprising a first valve 131 inside the housing 111, a rotating base 132 able to rotate with respect to the first valve 131 and at least a handle 133 partially outside the housing 111 for the user to operate, the switch valve 131 is disposed with two first water diversion openings 134 respectively connected to the two first diversion waterways 115, 116, the inlet waterway 114 is connected to the first valve 131, when controlling the rotating base 132 to rotate with respect to the first valve 131, the two first diversion openings are controlled to alternately connect to the inlet waterway.

The second diversion waterway 113 comprising a third flexible pipe 117 inside the housing, the lower joint 112 is fixed to the lower end of the housing 111, the lower joint 112 is connected to the third flexible pipe 117 and the second flexible pipe 410, the connection of the second diversion waterway 113 and the second flexible pipe 117 is situated in the lower portion of the flexible portion. the first flexible pipe 300 is assembled to the upper joint 113, the upper joint 113 is connected to the first flexible pipe 300 and the first switch mechanism 130 to lead water to the upper joint 113 and then to the first valve 131.

The connecting base 140 comprising a plug socket 141, which is fixed to the upper portion of the housing 111, preferred, the plug socket 141 and the handle 133 are respectively disposed in the left and the right sides of the housing 111.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A side-spraying outlet device assembled to a supporting arm that includes an inlet waterway, comprising:

a first flexible pipe connected to the supporting arm;

a side-spraying component having an upper end connected to the inlet waterway via the first flexible pipe, and being comprised of:

a fixed housing portion comprising a cylindrical housing containing first and second diversion waterways and having a side wall and upper and lower ends; and at least one water spraying nozzle disposed in the fixed housing portion and extending through the side wall of the cylindrical housing thereof, and connected to the first diversion waterway;

a second flexible pipe connected to the lower end of the fixed housing portion;

a hand-held shower head connected to the second flexible pipe and to the inlet waterway via the second diversion waterway;

a first valve switch disposed in the upper end of the fixed housing portion and cooperating with the first and second diversion waterways to switch from one diversion waterway to another diversion waterway to control water discharge from the at least one water spraying nozzle or the hand-held shower head; and a plurality of suction cup extending from the side wall of the fixed housing portion and being configured to mount directly onto a wall, wherein the at least one water spraying nozzle is disposed on a side wall of the cylindrical housing.

2. The side-spraying outlet device according to claim 1, further comprising a connecting base provided on the fixed housing portion to hold the hand-held shower head.

3. The side-spraying outlet device according to claim 1, wherein the fixed housing portion further comprises a lower joint provided at the lower end thereof, and an upper joint provided at the upper end thereof, wherein the second diversion waterway comprises a third flexible pipe provided inside the cylindrical housing, wherein the upper joint is connected to the first flexible pipe and the first switch mechanism, and wherein the lower joint is connected to the third flexible pipe and to the second flexible pipe.

4. The side-spraying outlet device according to claim 1, further comprising a connecting base including a plug socket provided on the fixed housing portion to hold the hand-held shower head.

5. The side-spraying outlet device according to claim 1, wherein the first valve switch comprises:

a valve provided inside the fixed housing portion and connected to the inlet waterway and having defined therein two water diversion openings respectively connected to the first and second diversion waterways; and a switching base configured to rotate with respect to the valve and thereby control connection of the two water diversion openings to the inlet waterway.

6. The side-spraying outlet device according to claim 1, further comprising;

a fixed head shower provided on the supporting arm; and a second valve switch provided in connection the supporting arm, the fixed head shower and the first flexible pipe, and configured to switch the fixed head shower or the first flexible pipe to connect to the inlet waterway.

7. The side-spraying outlet device according to claim 6, wherein the second valve switch comprises:

a valve provided in an end of the supporting arm in communication with the inlet waterway and having defined therein two water diversion openings respectively connected to the fixed head shower and to the first flexible pipe;

a switching base configured to rotate with respect to the valve to switch the two water diversion openings from one to another; and at least one handle extending partially outside of the valve for a user to operate the side-spraying outlet device.

8. A side-spraying outlet device assembled to a supporting arm that includes an inlet waterway, comprising:

a first flexible pipe connected to the supporting arm;

a side-spraying component having an upper end connected to the inlet waterway via the first flexible pipe, and being comprised of:

a fixed housing portion comprising a cylindrical housing containing first and second diversion waterways and having a side wall and upper and lower ends; and at least one water spraying nozzle disposed in the fixed housing portion and extending through the side wall of the cylindrical housing thereof, and connected to the first diversion waterway;

a second flexible pipe connected to the lower end of the fixed housing portion;

a hand-held shower head connected to the second flexible pipe and to the inlet waterway via the second diversion waterway; and a first valve switch disposed in the upper end of the fixed housing portion and cooperating with the first and second diversion waterways to switch from one diversion waterway to another diversion waterway to control water discharge from the at least one water spraying nozzle or the hand-held shower head.

9. The side-spraying outlet device according to claim 8, further comprising a connecting base including a plug socket fixed to the fixed housing, portion to hold the hand-held shower head.

10. The side-spraying outlet device according to claim 9, further comprising a plurality of suction cup extending from the side wall of the fixed housing portion and being configured to mount directly onto a wall, wherein the at least one water spraying nozzle is configured to only spray in a lateral direction when the fixed housing portion of the side-spraying component is arranged to extend in a vertical direction disposed on a side wall of the cylindrical housing.

11. The side-spraying outlet device according to claim 8, further comprising a plurality of suction cup extending from the side wall of the fixed housing portion and being configured to mount directly onto a wall.

12. The side-spraying outlet device according to claim 8, wherein the fixed housing portion further comprises a lower joint provided at the lower end thereof, and an upper joint provided at the upper end thereof, wherein the second diversion waterway comprises a third flexible pipe provided inside the cylindrical housing, wherein the upper joint is connected to the first flexible pipe and the first valve switch, and wherein the lower joint is connected to the third flexible pipe and to the second flexible pipe.

13. The side-spraying outlet device according to claim 8, wherein the first valve switch comprises:

a valve provided inside the fixed housing portion and connected to the inlet waterway and having defined therein two water diversion openings respectively connected to the first and second diversion waterways; and a switching base configured to rotate with respect to the valve and thereby control the connection of the two water diversion openings to the inlet waterway.

14. The side-spraying outlet device according to claim 8, further comprising:

a fixed head shower provided on the supporting arm; and a second valve switch provided in connection with the supporting arm, the fixed head shower and the first flexible pipe, and configured to switch the fixed head shower or the first flexible pipe to connect to the inlet waterway.

15. The side-spraying outlet device according to claim 14, wherein the second valve switch comprises:

a valve provided in an end of the supporting arm in communication with the inlet waterway and having defined therein two water diversion openings respectively connected to the fixed head shower and to the first flexible pipe;

a switching base configured to rotate with respect to the valve to switch the two water diversion openings from one to another; and at least one handle extending partially outside of the valve for a user to operate the side-spraying outlet device.

* * * * *